US008397686B2

(12) United States Patent
Davis

(10) Patent No.: US 8,397,686 B2
(45) Date of Patent: Mar. 19, 2013

(54) ENGINE INTAKE PORT ARRANGEMENT FOR CAMSHAFT WITH DIFFERENTIAL VALVE LIFT

(75) Inventor: Richard Stephen Davis, Lake Orion, MI (US)

(73) Assignee: GM Global Technology Operations LLC

( * ) Notice: Subject to any disclaimer, the term of this patent is extended or adjusted under 35 U.S.C. 154(b) by 471 days.

(21) Appl. No.: 12/639,246

(22) Filed: Dec. 16, 2009

(65) Prior Publication Data

US 2011/0139103 A1 Jun. 16, 2011

(51) Int. Cl.
*F01L 1/34* (2006.01)

(52) U.S. Cl. ..... 123/90.17; 123/90.15

(58) Field of Classification Search ..... 123/90.15, 123/90.17, 90.31
See application file for complete search history.

(56) References Cited

U.S. PATENT DOCUMENTS 3,516,394 A 6/1970 Nichols
4,760,821 A * 8/1988 Aupor et al. ..... 123/308
6,892,696 B2 * 5/2005 Tsukui ..... 123/308
7,845,075 B2 12/2010 Fritz et al.
2006/0236962 A1 * 10/2006 Fujii et al. ..... 123/90.16
2009/0159045 A1 6/2009 Hitomi et al.

FOREIGN PATENT DOCUMENTS

DE 19855932 A1 6/2000
JP 58206821 A 12/1983

* cited by examiner

*Primary Examiner* — Zelalem Eshete
(74) *Attorney, Agent, or Firm* — Harness, Dickey & Pierce, P.L.C.

(57) ABSTRACT

An engine assembly may include an engine structure, first and second intake valves, and a camshaft assembly. The engine structure may define a combustion chamber, a first intake port in communication with the combustion chamber and directing intake air flow toward a central region of the combustion chamber, and a second intake port in communication with the combustion chamber. The first intake valve may open and close the first intake port and the second intake valve may open and close the second intake port. The camshaft assembly may include a first intake lobe that opens the first intake valve and a second intake lobe that opens the second intake valve. The first intake lobe may be rotationally offset from the second intake lobe in a rotational direction of the camshaft assembly.

16 Claims, 10 Drawing Sheets

ENGINE INTAKE PORT ARRANGEMENT FOR CAMSHAFT WITH DIFFERENTIAL VALVE LIFT

FIELD

The present disclosure relates to engine valvetrains, and more specifically to intake port arrangements for concentric camshaft assemblies with differential valve lift.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. The valvetrain may include a camshaft that actuates intake and exhaust valves and thereby controls the timing and amount of air and fuel entering the cylinders and exhaust gases leaving the cylinders.

SUMMARY

An engine assembly may include an engine structure, first and second intake valves, first and second valve lift assemblies, and a camshaft assembly. The engine structure may define a combustion chamber, a first intake port in communication with the combustion chamber and directing intake air flow toward a central region of the combustion chamber, and a second intake port in communication with the combustion chamber. The first intake valve may be supported by the engine structure and may selectively open and close the first intake port. The second intake valve may be supported by the engine structure and may selectively open and close the second intake port. The first valve lift assembly may be engaged with the first intake valve and the second valve lift assembly may be engaged with the second intake valve. The camshaft assembly may be rotationally supported by the engine structure and may include a first intake lobe engaged with the first valve lift assembly and a second intake lobe engaged with the second valve lift assembly. The first intake lobe may be rotationally offset from the second intake lobe in a rotational direction of the camshaft assembly.

The first intake lobe may provide a first opening duration of the first intake valve during an expansion portion of an intake stroke of a piston located in the combustion chamber. The second intake lobe may provide a second opening duration of the second intake valve during the expansion portion of the intake stroke of the piston. The first opening duration may be greater than the second opening duration. The combustion chamber may define a centerline between outlets of the first and second intake ports. A terminal portion of the first intake port may define a flow path extending toward the centerline to direct intake air flow toward the central region of the combustion chamber.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
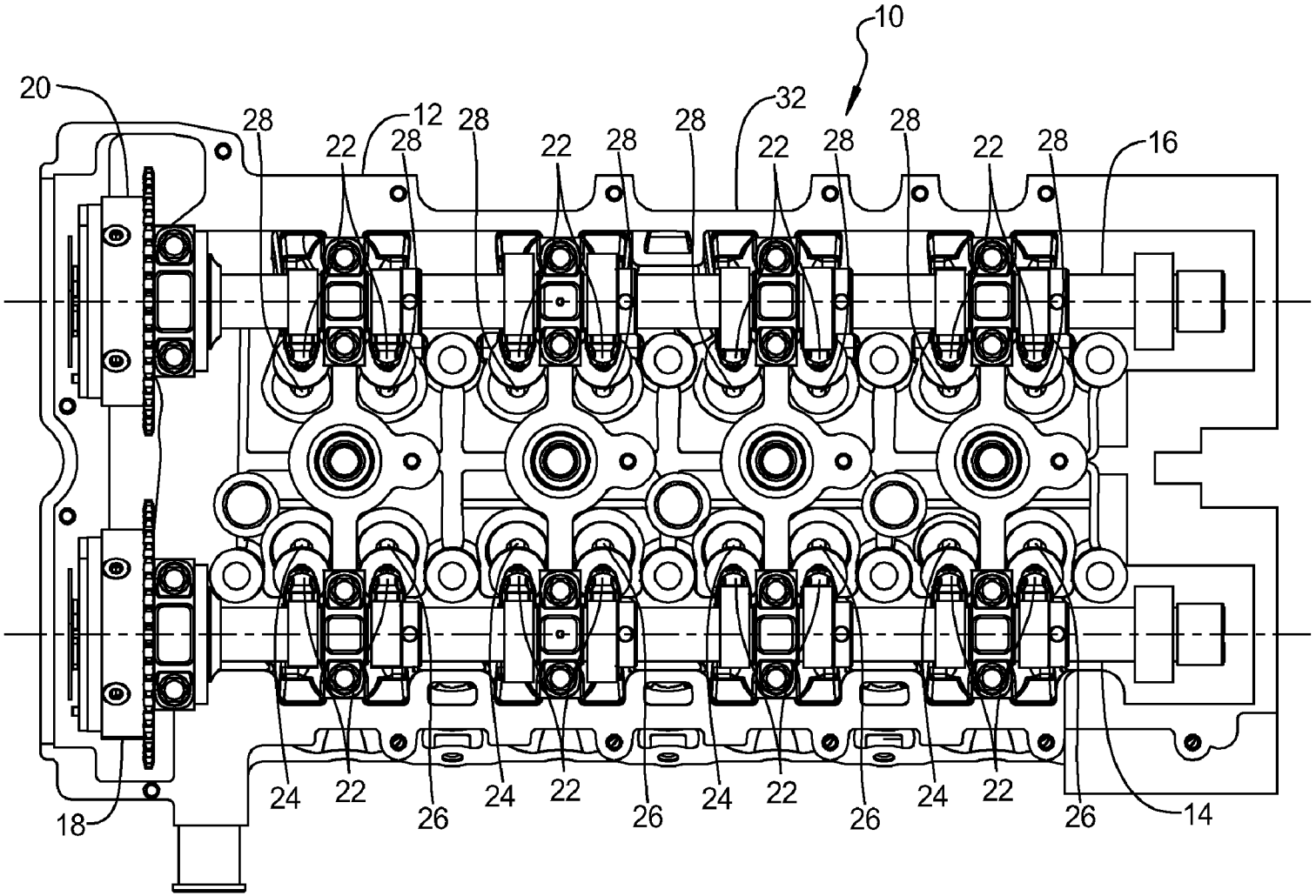
FIG. 1 is a plan view of an engine assembly according to the present disclosure.
Figure 2:
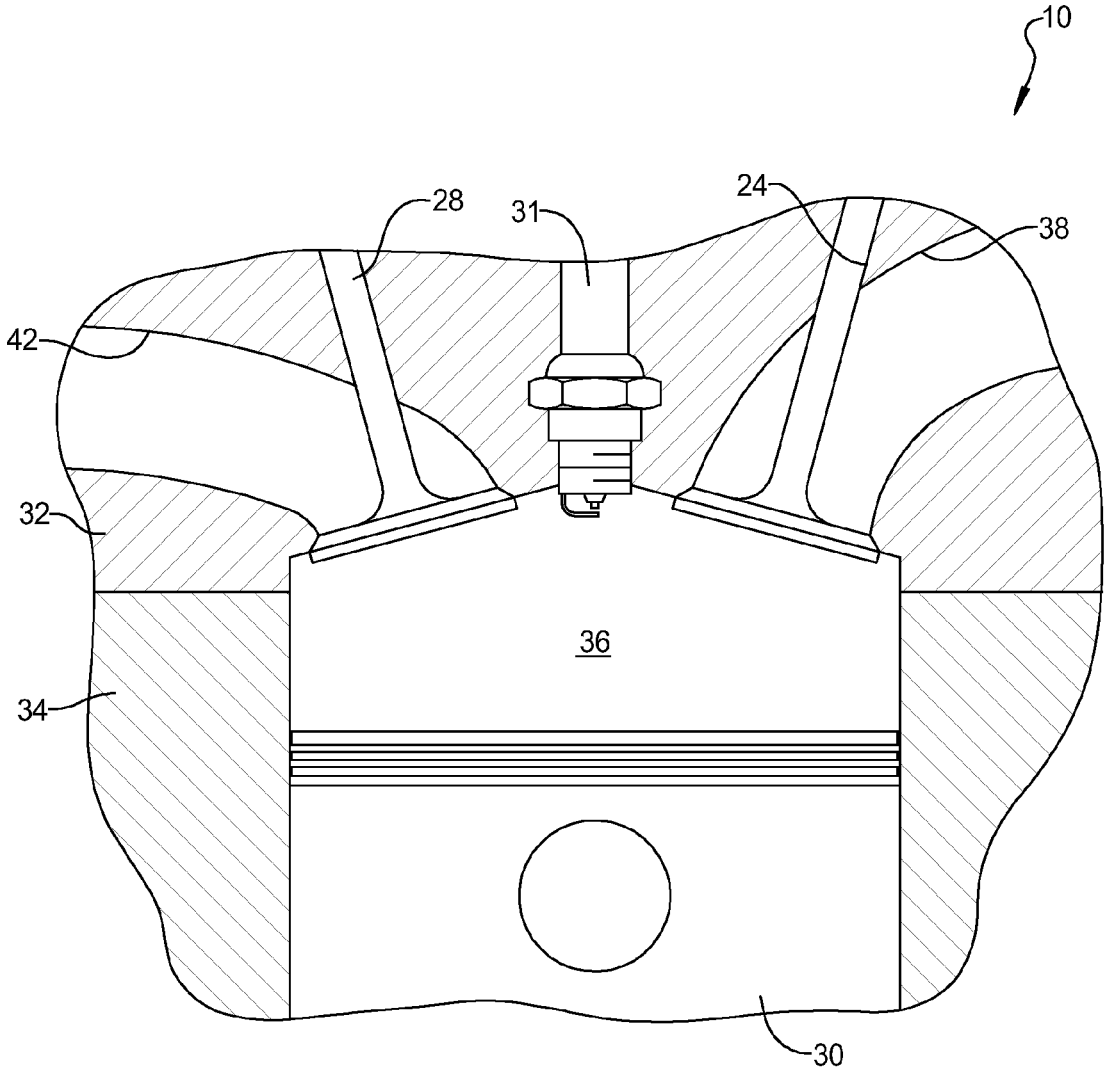
FIG. 2 is a schematic section view of the engine assembly of FIG. 1.
Figure 3:
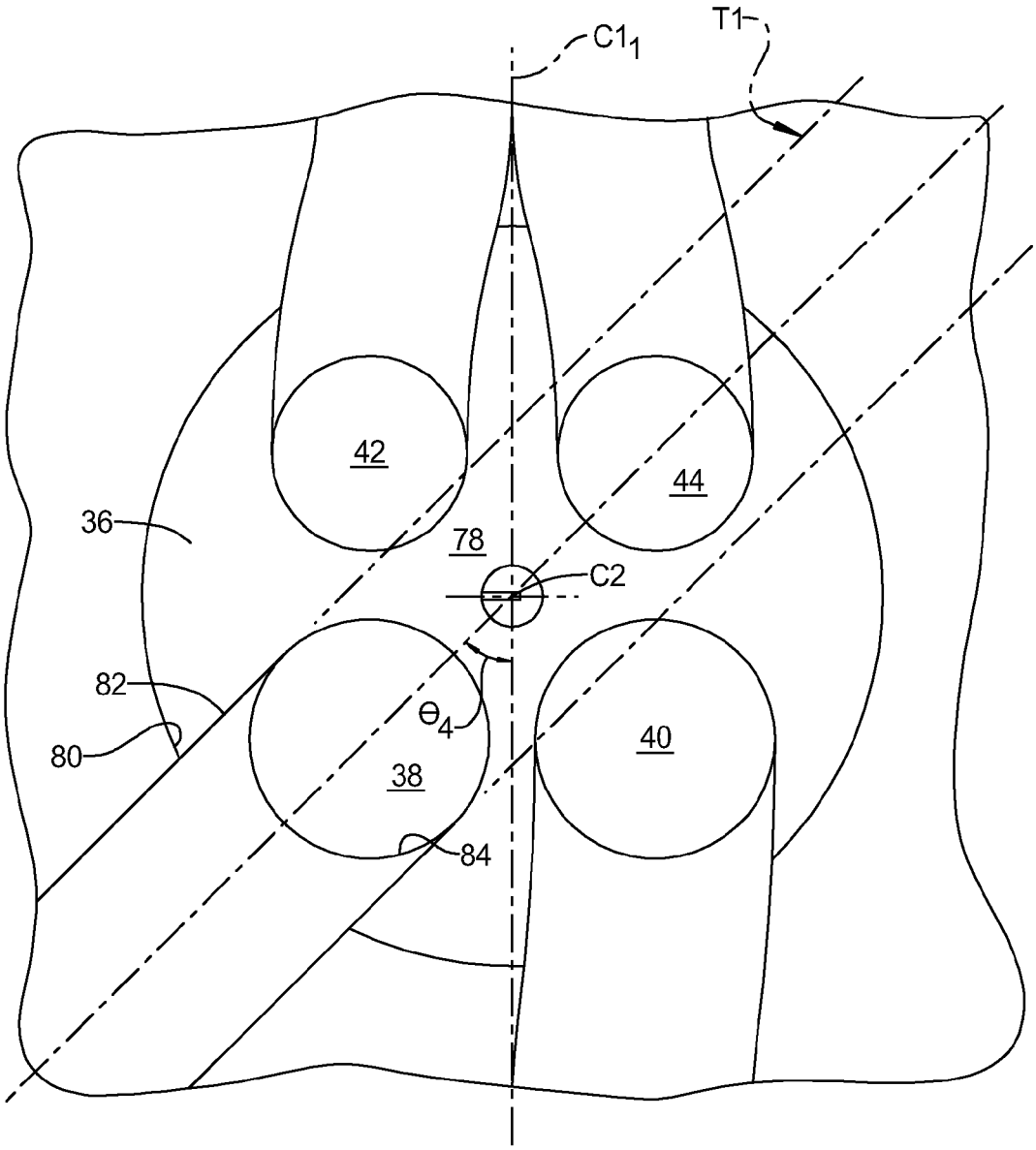
FIG. 3 is a schematic top plan illustration of intake and exhaust ports of the engine assembly of FIG. 1.

With reference to FIGS. 1-3, an engine assembly 10 is illustrated. The engine assembly 10 may include an engine structure 12, intake and exhaust camshaft assemblies 14, 16 rotationally supported on the engine structure 12, intake and exhaust cam phasers 18, 20, valve lift assemblies 22, first and second intake valves 24, 26, exhaust valves 28, pistons 30, and spark plugs 31. In the present non-limiting example, the engine assembly 10 is shown as a dual overhead camshaft engine with the engine structure 12 including a cylinder head 32 rotationally supporting the intake and exhaust camshaft assemblies 14, 16. The engine structure 12 may additionally include an engine block 34 cooperating with the cylinder head 32 and the pistons 30 to define combustion chambers 36 (FIG. 2).

As seen in FIGS. 2 and 3, the cylinder head 32 may define first and second intake ports 38, 40 and first and second exhaust ports 42, 44 for each combustion chamber 36. The valve lift assemblies 22 may be engaged with the first intake valves 24, the second intake valves 26 and the exhaust valves 28 to open the first and second intake ports 38, 40 and the first and second exhaust ports 42, 44. Specifically, the first intake valves 24 may open and close the first intake ports 38 and the second intake valves 26 may open and close the second intake ports 40.

Figure 4:
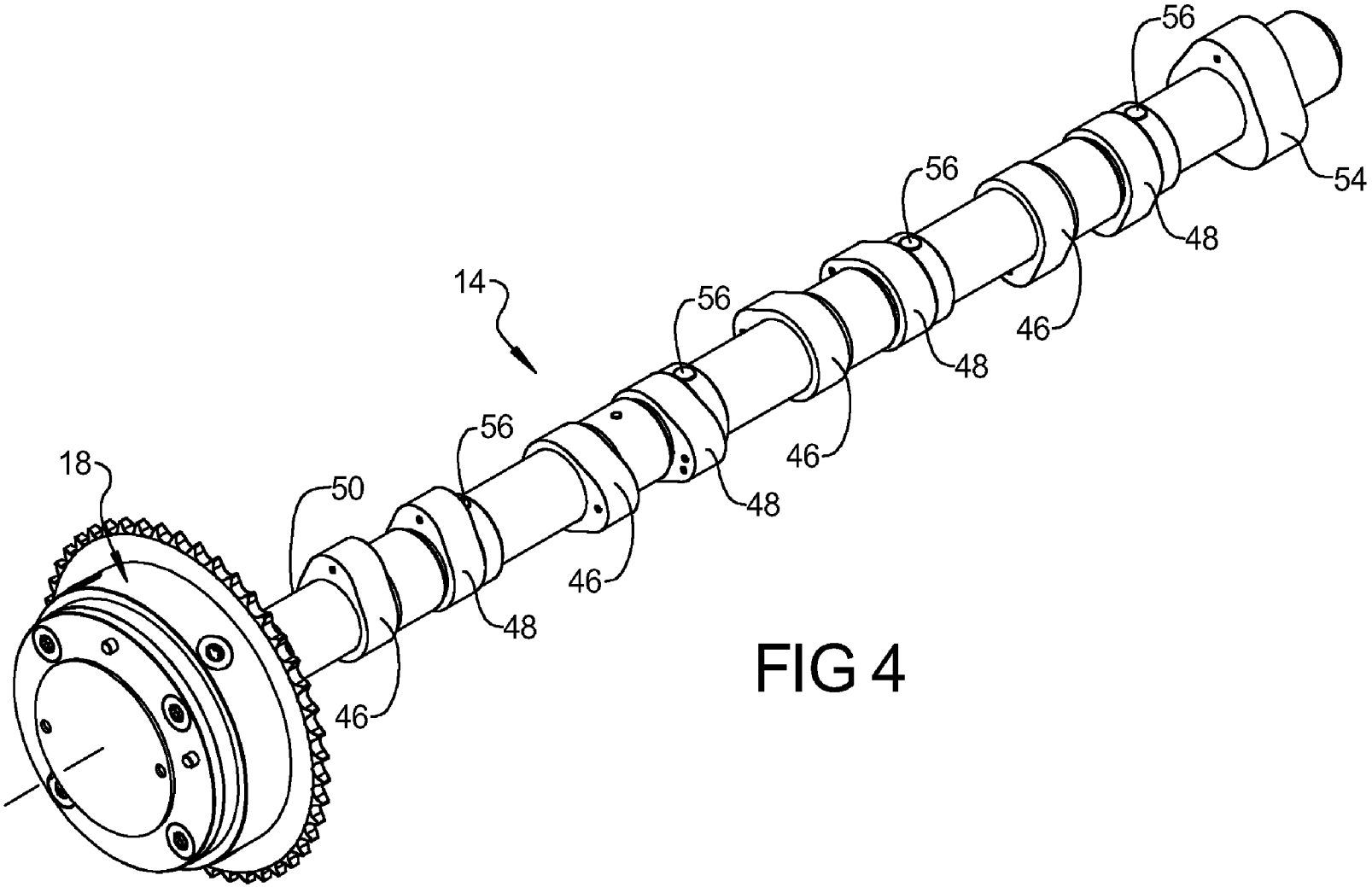
FIG. 4 is a perspective view of the intake cam phaser and intake camshaft assembly shown in FIG. 1.
Figure 5:
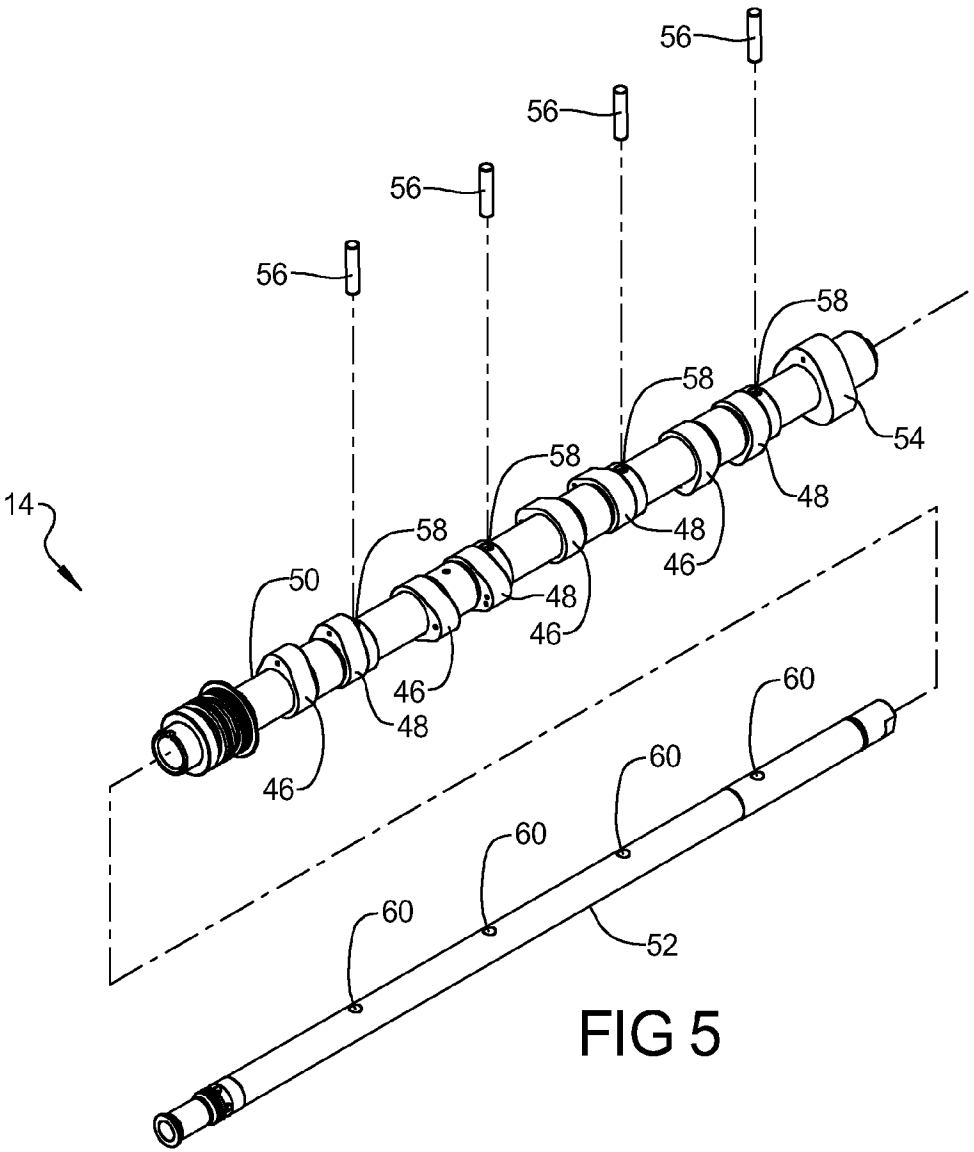
FIG. 5 is an exploded perspective view of the intake camshaft assembly shown in FIG. 1.

As seen in FIGS. 4 and 5, the intake camshaft assembly 14 may include first and second intake lobes 46, 48, first and second shafts 50, 52, and a fuel pump drive lobe 54. However, it is understood that the present disclosure applies equally to camshaft assemblies that do not include a fuel pump drive lobe. The first shaft 50 may be rotationally supported by the engine structure 12 and the second shaft 52 may be rotationally supported within the first shaft 50. The first intake lobes 46 may be located on and fixed for rotation with the first shaft 50. The second intake lobes 48 may be rotationally supported on the first shaft 50 and fixed for rotation with the second shaft 52. By way of non-limiting example, the second intake lobes 48 may be coupled to the second shaft 52 by pins 56 extending through apertures 58 in the second intake lobes 48 and apertures 60 in the second shaft 52. While illustrated as a concentric camshaft assembly, it is understood that the present disclosure is not limited to such arrangements and applies equally to fixed lobe camshafts.

Figure 7:
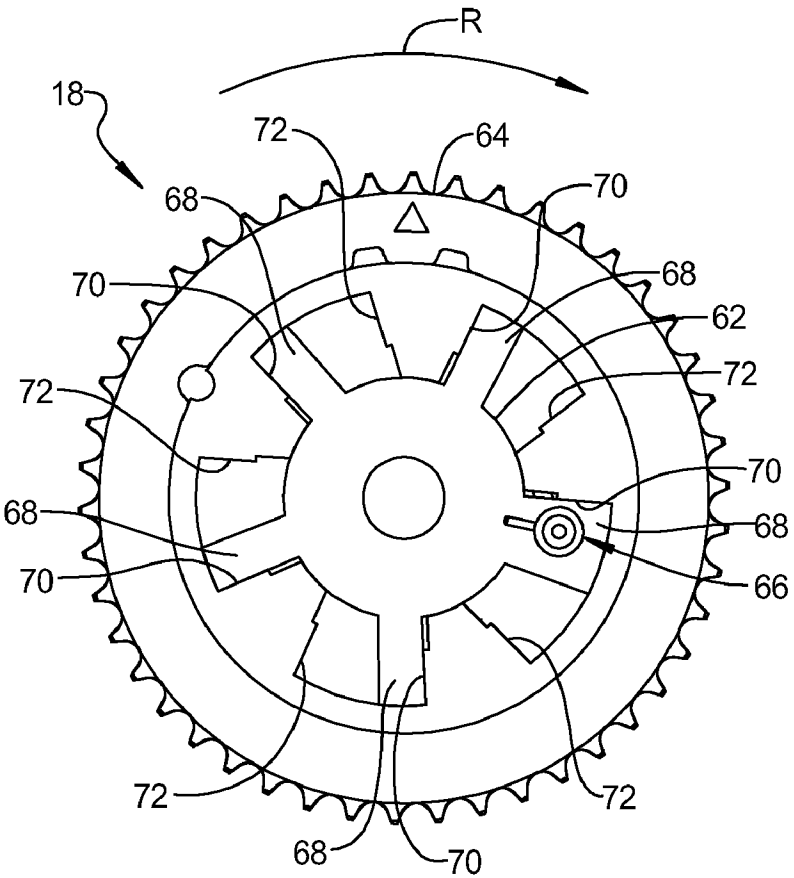
FIG. 7 is a schematic illustration of the intake cam phaser of FIG. 1 in a retarded position.
Figure 6:
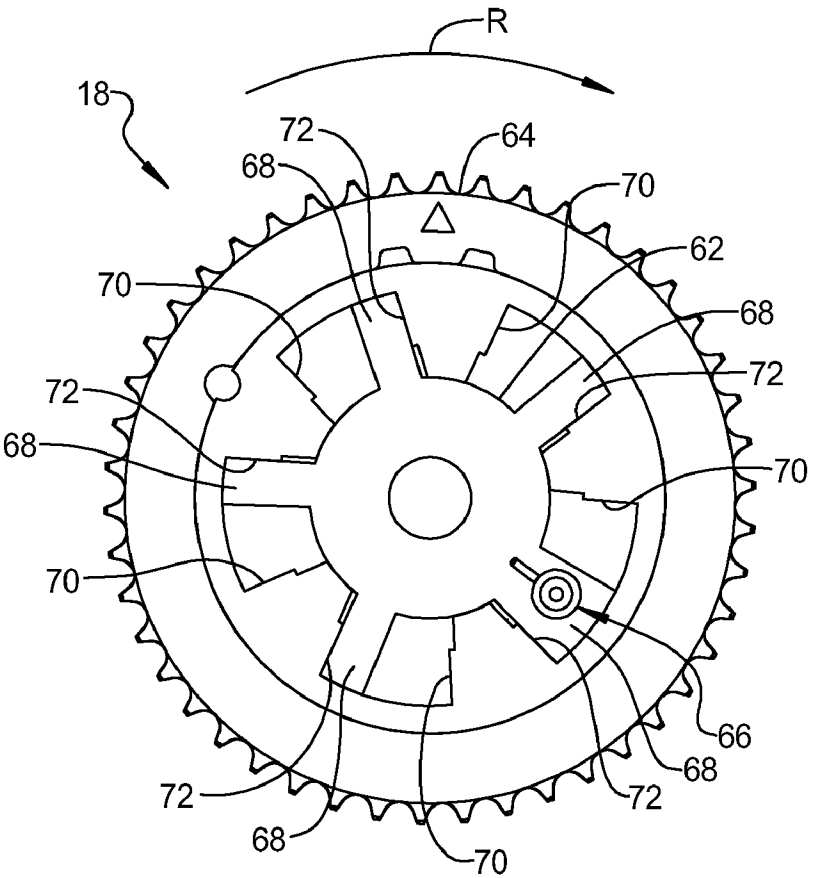
FIG. 6 is a schematic illustration of the intake cam phaser of FIG. 1 in an advanced position.

As seen in FIGS. 6 and 7, the intake cam phaser 18 may include a rotor 62, a stator 64 and a lock mechanism 66. The stator 64 may be rotationally driven by an engine crankshaft (not shown) and the rotor 62 may be rotationally supported within the stator 64. The rotor 62 may include radially extending vanes 68 cooperating with the stator 64 to define hydraulic advance and retard chambers 70, 72 in communication with pressurized fluid, such as oil.

The first shaft 50 (and therefore first intake lobes 46) may be fixed for rotation with the stator 64 and the second shaft 52 (and therefore second intake lobes 48) may be fixed for rotation with the rotor 62. The rotor 62 may be displaced from an advanced position (FIG. 6) to a retarded position (FIG. 7) to vary the opening timing of the second intake valves 26. The advanced position may correspond to a fully advanced position and the retarded position may correspond to a fully retarded position. While illustrated as a hydraulically actuated vane phaser, it is understood that the present disclosure is not limited to such arrangements. Further, while FIGS. 6 and 7 illustrate the intake cam phaser 18 in fully advanced and fully retarded positions, the intake cam phaser 18 may additionally provide an intermediate park position. By way of non-limiting example, the intermediate park position may include the locking mechanism 66 securing the rotor 62 between the advanced and retarded positions.

Figure 9:
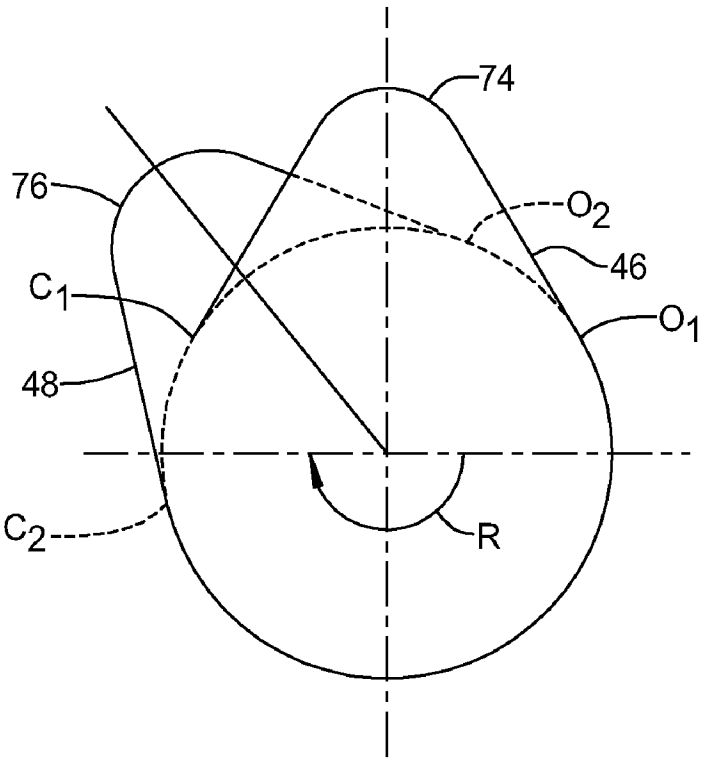
FIG. 9 is a schematic illustration of the intake cam lobe of FIG. 8 in a retarded position according to the present disclosure.
Figure 8:
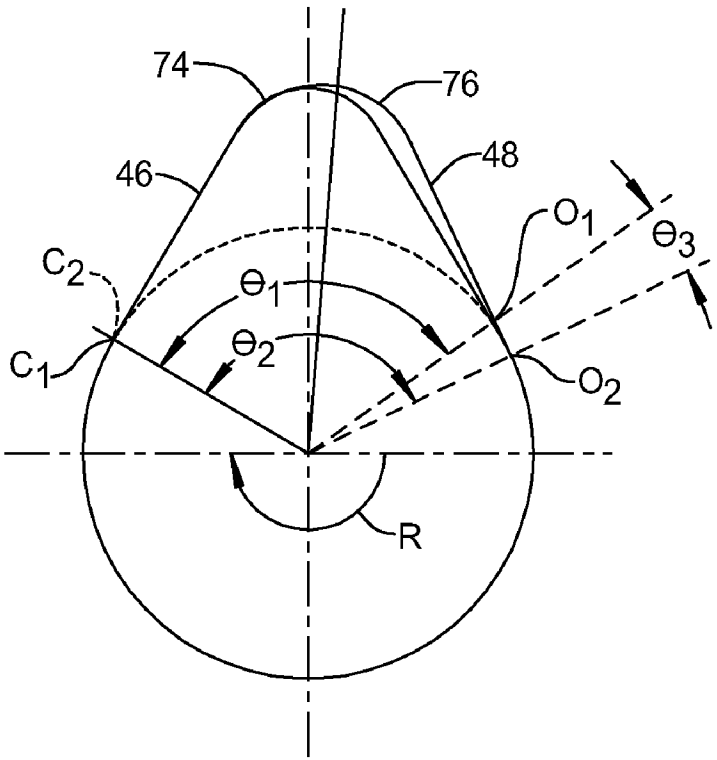
FIG. 8 is a schematic illustration of an intake cam lobe in an advanced position according to the present disclosure.

The first and second intake lobes 46, 48 are illustrated in FIGS. 8 and 9. The first intake lobe 46 may define a first valve opening region 74 having first angular extent ($\theta_1$) between a first starting (opening) point ($O_1$) and a first ending (closing) point ($C_1$). The second intake lobe 48 may define a second valve opening region 76 having a second angular extent ($\theta_2$) between a second starting (opening) point ($O_2$) and a second ending (closing) point ($C_2$). The second angular extent ($\theta_2$) may be greater than the first angular extent ($\theta_1$).

By way of non-limiting example, the second angular extent ($\theta_2$) may be at least five percent greater than the first angular extent ($\theta_1$), and more specifically between ten and twenty-five percent greater than the first angular extent ($\theta_1$). Therefore, the second angular extent ($\theta_2$) may be at least five degrees greater than the first angular extent ($\theta_1$), and more specifically between ten and twenty-five degrees greater than the first angular extent ($\theta_1$). However, it is understood that the present disclosure applies equally to arrangements where the first angular extent ($\theta_1$) is equal to the second angular extent ($\theta_2$) or where the first angular extent ($\theta_1$) is greater than the second angular extent ($\theta_2$).

The intake cam phaser 18 may displace the second intake lobes 48 from a first (advanced) position (FIG. 8) to a second (retarded) position (FIG. 9). In the advanced position, the first and second starting points ($O_1$, $O_2$) may be rotationally offset from one another and the first and second ending points ($C_1$, $C_2$) may be within five degrees of one another. More specifically, the first and second ending points ($C_1$, $C_2$) may be rotationally aligned with one another. By way of non-limiting example, the second starting point ($O_2$) may be located ahead of the first starting point ($O_1$) in a rotational direction (R) of the first and second intake lobes 46, 48 by an angle ($\theta_3$). The offset angle ($\theta_3$) may be at least five degrees and more specifically between ten and twenty-five degrees.

In the retarded position, the first and second starting points ($O_1$, $O_2$) may be rotationally offset from one another and the first and second ending points ($C_1$, $C_2$) may also be rotationally offset from one another. More specifically, the second starting point ($O_2$) may be located behind the first starting point ($O_1$) in the rotational direction (R). The second ending point ($C_2$) may also be located behind the first ending point ($C_1$) in the rotational direction (R). In the arrangement where the intake cam phaser 18 provides the intermediate park position, the locking mechanism 66 may secure the rotor 62 in a position where the first and second starting points ($O_1$, $O_2$) are rotationally aligned with one another.

The first intake ports 38 may direct intake air flow toward a central region 78 of the combustion chamber 36. In a first non-limiting example, shown in FIG. 3, the first intake port 38 may extend from an outer circumference 80 of the combustion chamber 36 toward a centerline ($C1_1$) of the combustion chamber 36 extending across the circumference 80 between the first and second intake ports 38, 40. More specifically, a terminal portion 82 of the first intake port 38 ending at an outlet 84 of the first intake port 38 may extend at an angle ($\theta_4$) relative to the centerline ($C1_1$). The angle ($\theta_4$) may be greater than ten degrees, and more specifically between thirty and sixty degrees. The orientation of the first intake port 38 may define an intake flow trajectory (T1) across the combustion chamber 36. By way of non-limiting example, the intake flow trajectory (T1) may intersect a diametrical center (C2) of the combustion chamber. The first intake port 38 may mitigate swirl generation in the combustion chamber 36 from air flow provided by the first intake port 38 by directing intake air flow toward a central region 78 of the combustion chamber 36.

The second intake port 40 may direct intake air flow toward the circumference 80 of the combustion chamber 36. In the non-limiting example of FIG. 3, the second intake port 40 may extend from the outer circumference 80 of the combustion chamber 36 away from the centerline ($C1_1$) of the combustion chamber 36. The second intake port 40 may generate swirl in the intake air flow in the combustion chamber 36 from the second intake port 40 by directing the intake air flow toward the circumference 80 of the combustion chamber 36.

Figure 11:
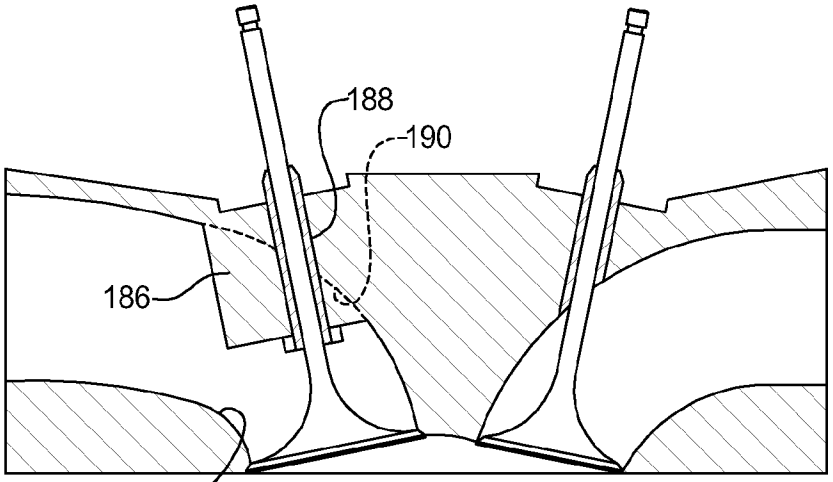
FIG. 11 is a schematic section view of the intake port arrangement of FIG. 10.
Figure 10:
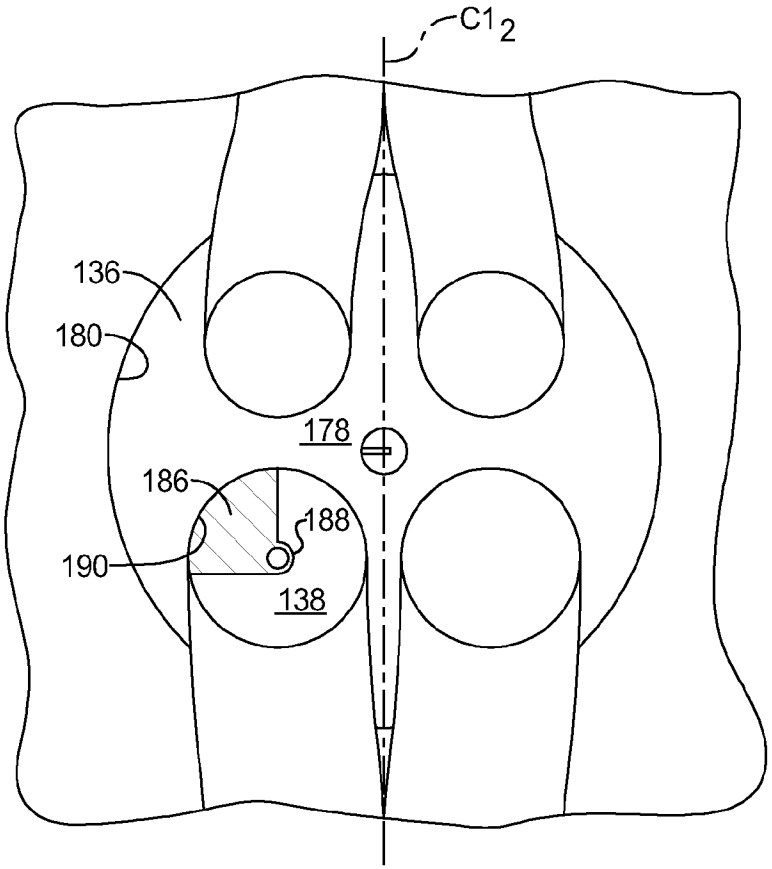
FIG. 10 is a schematic top plan illustration of an alternate intake port arrangement according to the present disclosure.

In another non-limiting example, shown in FIGS. 10 and 11, the first intake port 138 may include a guide member 186 directing intake air flow toward the central region 178 of the combustion chamber 136. The guide member 186 may extend between a valve guide boss 188 in the first intake port 138 and a wall 190 of the first intake port 138 adjacent the circumference 180 of the combustion chamber 136. The guide member 186 may effectively inhibit intake air flow from the first intake port 138 from travelling outward from the centerline ($C1_2$) toward the circumference 180. Instead, the guide member 186 may effectively direct intake air flow from the first intake port 138 in a direction from the circumference 180 toward the centerline ($C1_2$), and therefore toward the central region 178 of the combustion chamber 136.

Figure 12:
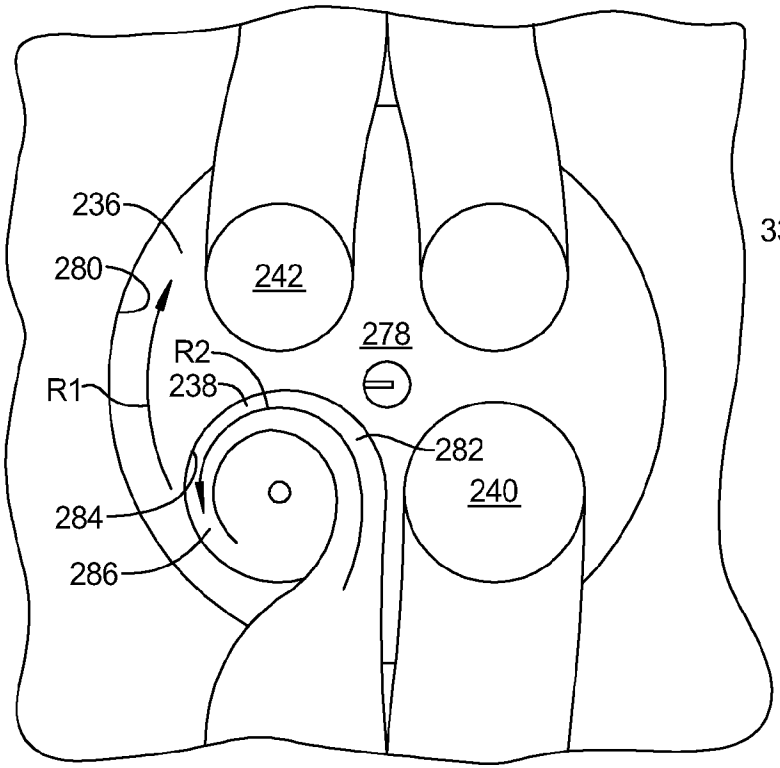
FIG. 12 is a schematic top plan illustration of an alternate intake port arrangement according to the present disclosure.

In another non-limiting example, shown in FIG. 12, the first intake port 238 may define a spiral flow path 286, forming a swirl or helical port. The spiral flow path 286 may be defined at a terminal portion 282 of the first intake port 238 ending at the outlet 284 of the first intake port 238. The spiral flow path 286 may generate a rotational flow path for intake air flow provided by the first intake port 238 that is generally opposite the direction of swirl typically generated in the combustion chamber 236 from the first intake port 238.

By way of non-limiting example, a typical swirl flow direction may include a rotational direction along the circumference 280 in a first rotational direction (R1) from the first intake port 238 to the adjacent exhaust port 242. The spiral flow path 286 may provide the rotational flow path for intake air flow provided by the first intake port 238 in a second rotational direction (R2) from the first intake port 238 toward the second intake port 240 and opposite the first rotational direction (R1). The second rotational direction (R2) provided by the spiral flow path 286 may counteract the tendency of the intake air flow to generate swirl and may result in the intake air flow from the first intake port 238 being directed toward the central region 278 of the combustion chamber 236.

Figure 13:
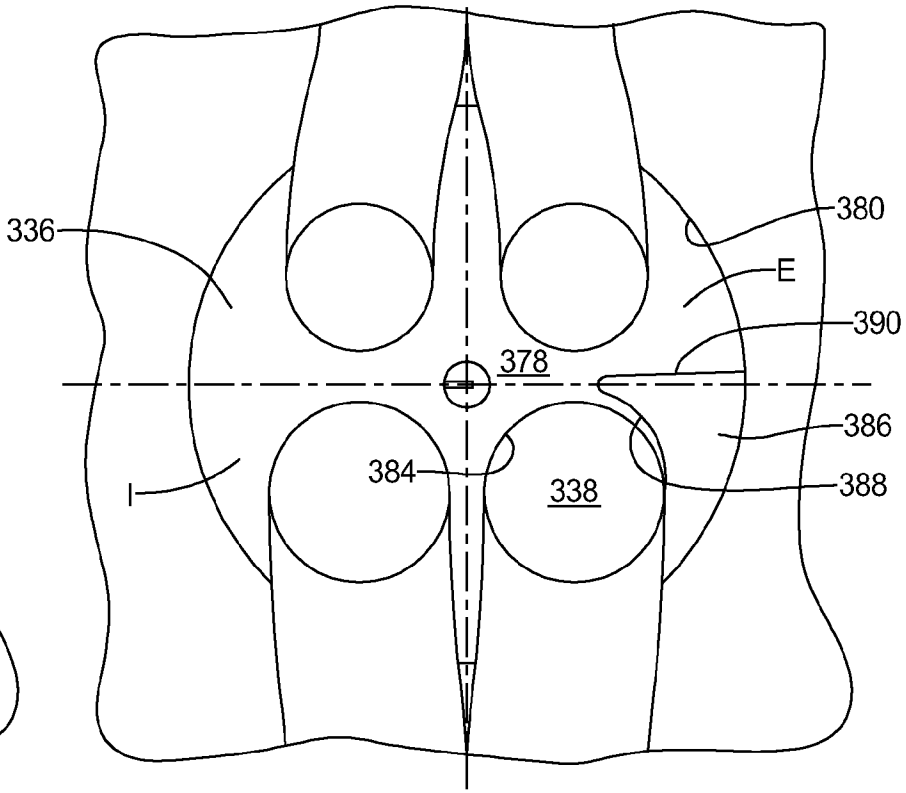
FIG. 13 is a schematic bottom plan illustration of an alternate intake port arrangement according to the present disclosure.

In another non-limiting example, shown in FIG. 13, the first intake port 338 may include a protrusion 386 forming a valve shroud at the outlet 384. FIG. 13 is a bottom view of the port arrangement, therefore the orientation will appear opposite that in the previous top views. The protrusion 386 may extend radially inward from the circumference 380 of the combustion chamber 336 toward the centerline ($C1_3$). The protrusion 386 may include first and second surfaces 388, 390 extending along a longitudinal direction of the combustion chamber 336. The first surface 388 may face an intake side (I) of the combustion chamber 336 and the second surface 390 may face an exhaust side (E) of the combustion chamber 336. More specifically, the first surface 388 may form a curved surface extending around the outlet 384 between the first intake port 338 and the circumference 380 of the combustion chamber 336 and between the first intake port 338 and the exhaust side (E) of the combustion chamber 336. The first surface 388 may direct intake air flow from the first intake port 338 toward the central region 378 of the combustion chamber 336.

Figure 14:
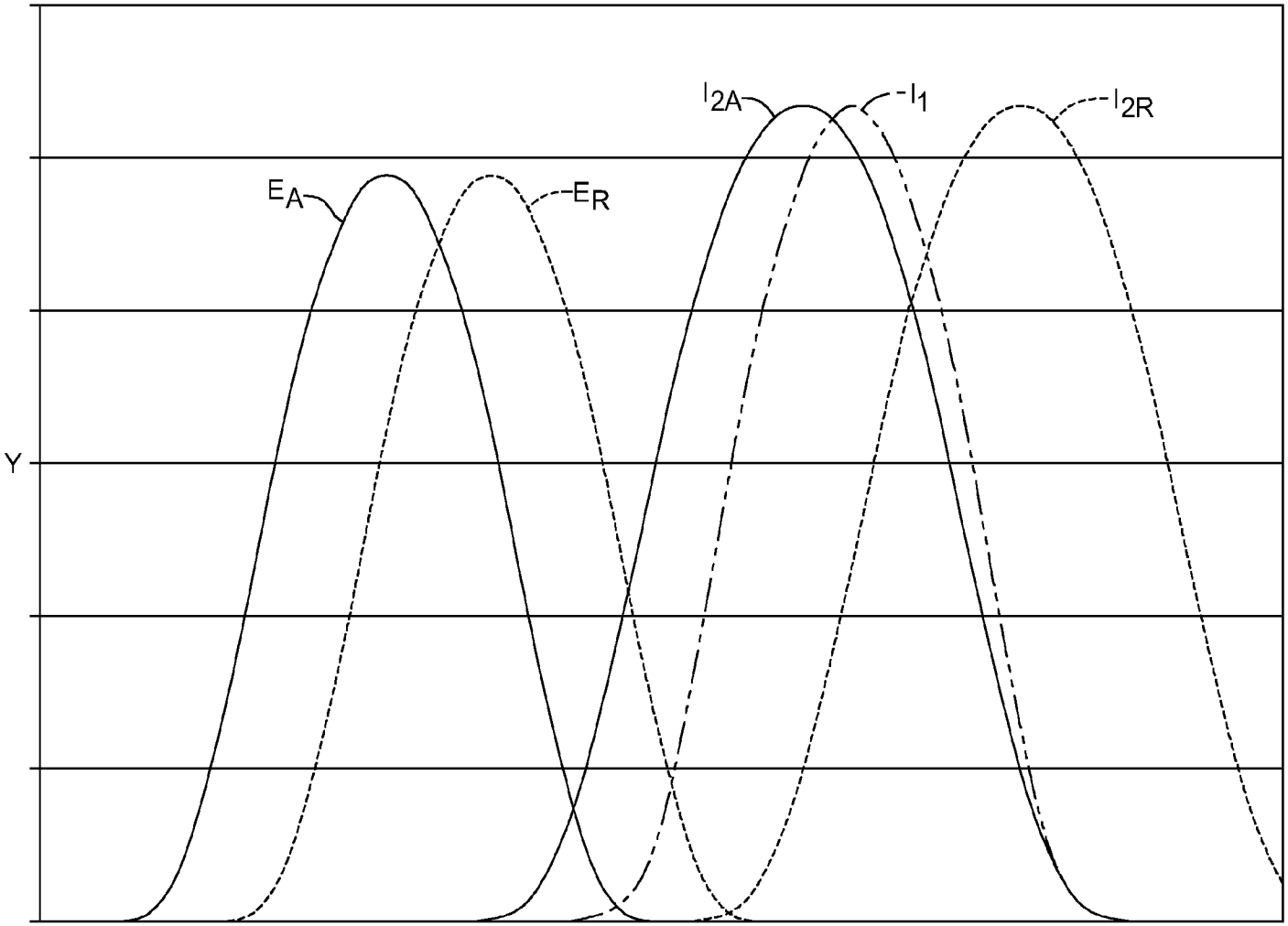
FIG. 14 is a graphical illustration of valve opening profiles according to the present disclosure.

FIG. 14 illustrates the displacement of the second intake valves 26 relative to the first intake valves 24 and relative to the exhaust valves 28 during operation. In the graph shown in FIG. 14, the x-axis represents the rotational angle of the intake and exhaust camshaft assemblies 14, 16 and the y-axis represents valve lift. The curve ($E_A$) represents the exhaust camshaft assembly 16 advanced and the curve ($E_R$) represents the exhaust camshaft assembly 16 retarded. The curve ($I_1$) represents the first (fixed) intake lobe 46, the curve ($I_{2A}$) represents the second (phased) intake lobe 48 advanced and the curve ($I_{2R}$) represents the second (phased) intake lobe 48 retarded. The advanced and retarded positions of the exhaust camshaft assembly 16 and the second (phased) intake lobe 48 may correspond to fully advanced and fully retarded positions, respectively.

As illustrated in FIG. 14, when the second intake lobe 48 is in the advanced position, the opening of the second intake valve 26 occurs before the opening of the first intake valve 24 and the closing of the second intake valve 26 is aligned with the closing of the first intake valve 24. However, as indicated above, the present disclosure is not limited to such arrangements. When the second intake lobe 48 is in the retarded position, the opening of the second intake valve 26 occurs after the opening of the first intake valve 24 and closing of the second intake valve 26 occurs after the closing of the first intake valve 24. Also, as seen in FIG. 14, varying the opening and closing timing of the second intake valves 26 and the exhaust valves 28 may be used to vary valve overlap conditions. The present disclosure provides for greater variability of valve timing to realize benefits at different engine operating conditions.

By way of non-limiting example, the second intake lobes 48 may be in the first (advanced) position during low engine speed wide open throttle (WOT) conditions to optimize volumetric efficiency and torque. The second intake lobes 48 may also be in the first (advanced) position during ambient cold start conditions to increase the level of overlap between the opening of the second intake valves 26 and the exhaust valves 28. The increased overlap may generally provide for reduced hydrocarbon (HC) emission from the engine assembly 10. The second intake lobes 48 may be in the second (retarded) position during part-load engine conditions to provide delayed closing of the second intake valves 26 for reducing engine pumping loss and improving fuel economy.

The second intake lobes 48 may be in an intermediate position (between advanced and retarded) during mid and high speed WOT operating conditions to optimize the second intake valve 26 closing timing for improved volumetric efficiency and increased torque and power. The second intake lobes 48 may additionally be in the intermediate position during light load conditions, such as idle, to provide reduced overlap between the second intake valves 26 and the exhaust valves 28 and moderate the effective compression ratio to optimize light load combustion stability.

When the second intake lobe 48 is in the retarded or intermediate position, the first intake valve 24 may have a first opening duration during an expansion portion of the intake stroke of the piston 30 that is greater than a second opening duration of the second intake valve 26. The greater opening duration of the first intake valve 24 during an expansion portion of the intake stroke of the piston 30 may generally cause swirl in the combustion chamber 36 due to the imbalance in intake air flow from the first and second intake ports 38, 40. Each of the examples discussed above may generally limit or prevent the first intake port 38, 138, 238, 338 from generating swirl in the combustion chamber 36, 136, 236, 336 due to this intake air flow imbalance.

What is claimed is:

1. An engine assembly comprising:

an engine structure defining:

a combustion chamber;

a first intake port in communication with the combustion chamber and directing intake air flow toward a central region of the combustion chamber; and a second intake port in communication with the combustion chamber, wherein a centerline of the combustion chamber is defined between outlets of the first and second intake ports, a terminal portion of the first intake port defining a flow path extending toward the centerline;

a first intake valve supported by the engine structure and selectively opening and closing the first intake port;

a second intake valve supported by the engine structure and selectively opening and closing the second intake port;

a first valve lift assembly engaged with the first intake valve;

a second valve lift assembly engaged with the second intake valve; and a camshaft assembly rotationally supported by the engine structure and including first and second shafts, the second shaft coaxial with and rotatable relative to the first shaft, a first intake lobe fixed for rotation with the first shaft and engaged with the first valve lift assembly and a second intake lobe fixed for rotation with the second shaft and engaged with the second valve lift assembly, the first intake lobe rotationally offset from the second intake lobe in a rotational direction of the camshaft assembly.

2. The engine assembly of claim 1, further comprising a cam phaser coupled to the first and second shafts and adapted to rotate the second shaft from a first rotational position to a second rotational position relative to the first shaft, the first intake lobe being rotationally offset from the second intake lobe in the rotational direction of the camshaft assembly when the second shaft is in the first rotational position.

3. The engine assembly of claim 2, wherein the cam phaser includes a first member rotationally driven by a crankshaft and a second member rotatable relative to the first member, the first shaft fixed for rotation with the first member and the second shaft fixed for rotation with the second member.

4. The engine assembly of claim 1, wherein the first lobe includes a first starting point for opening the first intake valve and the second lobe includes a second starting point for opening the second intake valve, the first starting point being rotationally offset from the second starting point in the rotational direction of the camshaft assembly.

5. The engine assembly of claim 1, wherein a terminal portion of the first intake port extends toward the second intake port.

6. The engine assembly of claim 1, wherein an angle defined between the flow path and the centerline is at least 10 degrees.

7. The engine assembly of claim 1, wherein a terminal portion of the second intake port extends away from the centerline.

8. The engine assembly of claim 1, wherein a terminal portion of the first intake port defines an intake air flow trajectory intersecting a diametrical center of the combustion chamber.

9. The engine assembly of claim 1, wherein the first intake port includes a guide member extending between a valve guide boss in the first intake port and a wall of the first intake port opposite the second intake port to direct intake air flow toward the central region of the combustion chamber.

10. The engine assembly of claim 1, wherein a terminal portion of the first intake port defines spiral flow path directing intake air flow in a rotational direction from the first intake port toward the second intake port.

11. The engine assembly of claim 1, wherein the engine structure defines an end surface of the combustion chamber and includes a protrusion extending longitudinally therefrom and radially inward from a circumference of the combustion chamber to a location between the first intake port and a first exhaust port adjacent the first intake port, a first lateral side of the protrusion defining a curved surface extending around the first intake port to direct intake air flow toward the central region of the combustion chamber.

12. An engine assembly comprising:

an engine structure defining:

a combustion chamber;

a first intake port in communication with the combustion chamber and directing intake air flow toward a central region of the combustion chamber; and a second intake port in communication with the combustion chamber, wherein a centerline of the combustion chamber is defined between outlets of the first and second intake ports, a terminal portion of the first intake port defining a flow path extending toward the centerline;

a piston located within the combustion chamber;

a first intake valve supported by the engine structure and selectively opening and closing the first intake port;

a second intake valve supported by the engine structure and selectively opening and closing the second intake port;

a first valve lift assembly engaged with the first intake valve;

a second valve lift assembly engaged with the second intake valve; and a camshaft assembly rotationally supported by the engine structure and including first and second shafts, the second shaft coaxial with and rotatable relative to the first shaft, a first intake lobe fixed for rotation with the first shaft and engaged with the first valve lift assembly and a second intake lobe fixed for rotation with the second shaft and engaged with the second valve lift assembly, the first intake lobe rotationally offset from the second intake lobe in a rotational direction of the camshaft assembly and providing a first opening duration of the first intake valve during an expansion portion of an intake stroke of the piston that is greater than a second opening duration of the second intake valve during the expansion portion of the intake stroke.

13. The engine assembly of claim 12, further comprising a cam phaser coupled to the first and second shafts and adapted to rotate the second shaft from a first rotational position to a second rotational position relative to the first shaft, the first intake lobe being rotationally offset from the second intake lobe in the rotational direction of the camshaft assembly when the second shaft is in the first rotational position.

14. An engine assembly comprising:

an engine structure defining:

a combustion chamber;

a first intake port in communication with the combustion chamber; and a second intake port in communication with the combustion chamber, a centerline of the combustion chamber defined between outlets of the first and second intake ports, and a terminal portion of the first intake port defining a flow path extending toward the centerline;

a piston located within the combustion chamber;

a first intake valve supported by the engine structure and selectively opening and closing the first intake port;

a second intake valve supported by the engine structure and selectively opening and closing the second intake port;

a first valve lift assembly engaged with the first intake valve;

a second valve lift assembly engaged with the second intake valve; and a camshaft assembly rotationally supported by the engine structure and including a first intake lobe engaged with the first valve lift assembly and a second intake lobe engaged with the second valve lift assembly, the first intake lobe rotationally offset from the second intake lobe in a rotational direction of the camshaft assembly and providing a first opening duration of the first intake valve during an expansion portion of an intake stroke of the piston that is greater than a second opening duration of the second intake valve during the expansion portion of the intake stroke.

15. The engine assembly of claim 14, wherein an angle defined between the flow path and the centerline is at least 10 degrees.

16. The engine assembly of claim 14, wherein a terminal portion of the second intake port extends away from the centerline.

* * * * *